US005346602A

United States Patent [19]

McLaughlin

[11] Patent Number: 5,346,602

[45] Date of Patent: Sep. 13, 1994

[54] MOBILE ELECTROPLATING UNIT

[75] Inventor: Daniel A. McLaughlin, Madeira Beach, Fla.

[73] Assignee: Gold Effects, Inc., Madeira Beach, Fla.

[21] Appl. No.: 126,375

[22] Filed: Sep. 24, 1993

[51] Int. Cl.[5] ..... C25D 17/00; C25D 17/14

[52] U.S. Cl. ..... 204/224 R; 204/271

[58] Field of Search ..... 204/224 R, 271

[56] References Cited

U.S. PATENT DOCUMENTS

| | | | |
|---|---|---|---|
| 2,698,832 | 1/1955 | Swanson | 204/224 R |
| 2,961,395 | 11/1960 | Icxi | 204/224 R |
| 3,520,792 | 7/1970 | Kerschgens | 204/224 R |
| 3,752,752 | 8/1973 | Slatin et al. | 204/194 |
| 3,755,089 | 8/1973 | Rapids | 204/224 R X |
| 4,035,246 | 7/1977 | Rapids | 204/224 R X |
| 4,668,364 | 5/1987 | Farmer et al. | 204/224 R |
| 4,810,343 | 3/1989 | Bonnardel | 204/224 R |

*Primary Examiner*—Donald R. Valentine
*Attorney, Agent, or Firm*—Herbert W. Larson

[57] ABSTRACT

A compact, hand portable mobile electroplating unit provided with wheels, a seat for the user, and all of the chemical solutions and applicator equipment, including a D.C. power source, required to electroplate a metallic film on a metallic surface.

27 Claims, 5 Drawing Sheets

MOBILE ELECTROPLATING UNIT

FIELD OF THE INVENTION

This invention relates to a compact, hand portable, mobile electroplating unit which incorporates all of the materials and equipment, including a D.C. power source, required for electroplating a metallic surface while the user is seated on the unit. In particular, this invention relates to such a unit for electroplating gold on selected metallic surfaces of automobiles.

BACKGROUND OF THE INVENTION

U.S. Pat. Nos. 3,752,752 and 4,668,364 disclose hand portable electroplating kits. The kit shown in each of the patents comprises an attache or brief case in which the equipment for performing an electroplating operation is housed. The brief case type arrangement of the patented kits requires that they be supported on a stable surface during use, and that an operator or user take a position in front of and facing the open case and the harmful, or even dangerous, metal treating chemicals contained in the lower compartment of the kit. Apart from the hazards inherent in the use of the kits, they lack the mobility and maneuverability called for in the in-place gold plating of emblems and other metal surfaces of a motor vehicle where frequent changing of positions and orientation with relation to a surface to be plated are necessary. The kits shown in the patents have the further disadvantage of requiring manual control by a user of voltage output for each plating operation, an in-exact procedure which can lead to an unsatisfactory or poor finished product. The kit shown in U.S. Pat. No. 4,668,364 has a unique disadvantage in that it utilizes a 24 carat gold anode to electroplate a gold film on a surface. Wholly apart from the prohibitive expense of employing an anode of that character in any plating operation, let alone in the gold plating of emblems and other metal surfaces of an automobile, the expense of providing adequate security to prevent theft of the gold anode would militate against the use of the apparatus shown in the patent.

SUMMARY OF THE INVENTION

In accordance with the present invention, a lightweight, hand portable, easily maneuverable, mobile electroplating unit is provided which, while adaptable for use in any electroplating operation where portability and maneuverability are considerations, is especially suitable for use in electrolytically gold plating emblems, grills, and other metallic surfaces on automotive vehicles. The unit is provided with wheels for ease of movement by a user to any desired position on the outside of an automobile. In addition, the unit is provided with a seat to enable a user to assume a sitting position on the unit with his or her face and hands a safe distance from the plating solutions supported on the unit, and yet permitting ready and safe access to the solutions. A D.C. power source having a plurality of receptacles is provided on the unit which is unique in that the voltage and current output at each receptacle is automatically maintained at an optimum predetermined level thereby eliminating any power surges, and the need for any manual control of voltage output by the user. This feature of the D.C. power service employed with the unit has the further advantage of preventing shorts or arcs which would otherwise occur if a plating electrode accidentally came into contact with the surface of a workpiece during plating. The unit also is provided with a plurality of hand manipulated chemical solution applicators each of which is connectable by a wire lead to the D.C. power source through the voltage output receptacles of the power source. Each of the applicators carries an anode for applying a single chemical plating solution on a workpiece. Each of the anodes is detachable from its associated applicator for storage and transportability, and advantageously is provided with an absorbent sleeve or cover for ease in applying the chemical solutions, and, further, to prevent any accidental contact between the anode and the workpiece which may damage the surface of the workpiece as by scratching. A complete circuit between the D.C. power source and the workpiece is attained by a hand manipulated member which is connectable to the power source through a receptacle on the power source, and acts as a cathode or anode during the plating operation. The unit has means which serves to maintain the applicators in a stable position over their associated chemical solution container when not in use, and acts to prevent the wire leads carried by the applicators from coming into contact with the solutions in the containers. The unit also incorporates storage means within each reach of a user seated on the unit for holding plating solutions and other equipment useful for carrying out a plating operation.

The various features of novelty which characterize the invention are set forth with particularity in the claims annexed to and forming a part of the present disclosure. For a better understanding of the invention, its advantages, and the outstanding results attained through its use, reference is made to the accompanying drawings and descriptive matter in which a preferred embodiment of the invention is illustrated and described.

DETAILED DESCRIPTION OF THE INVENTION

Figure 1:
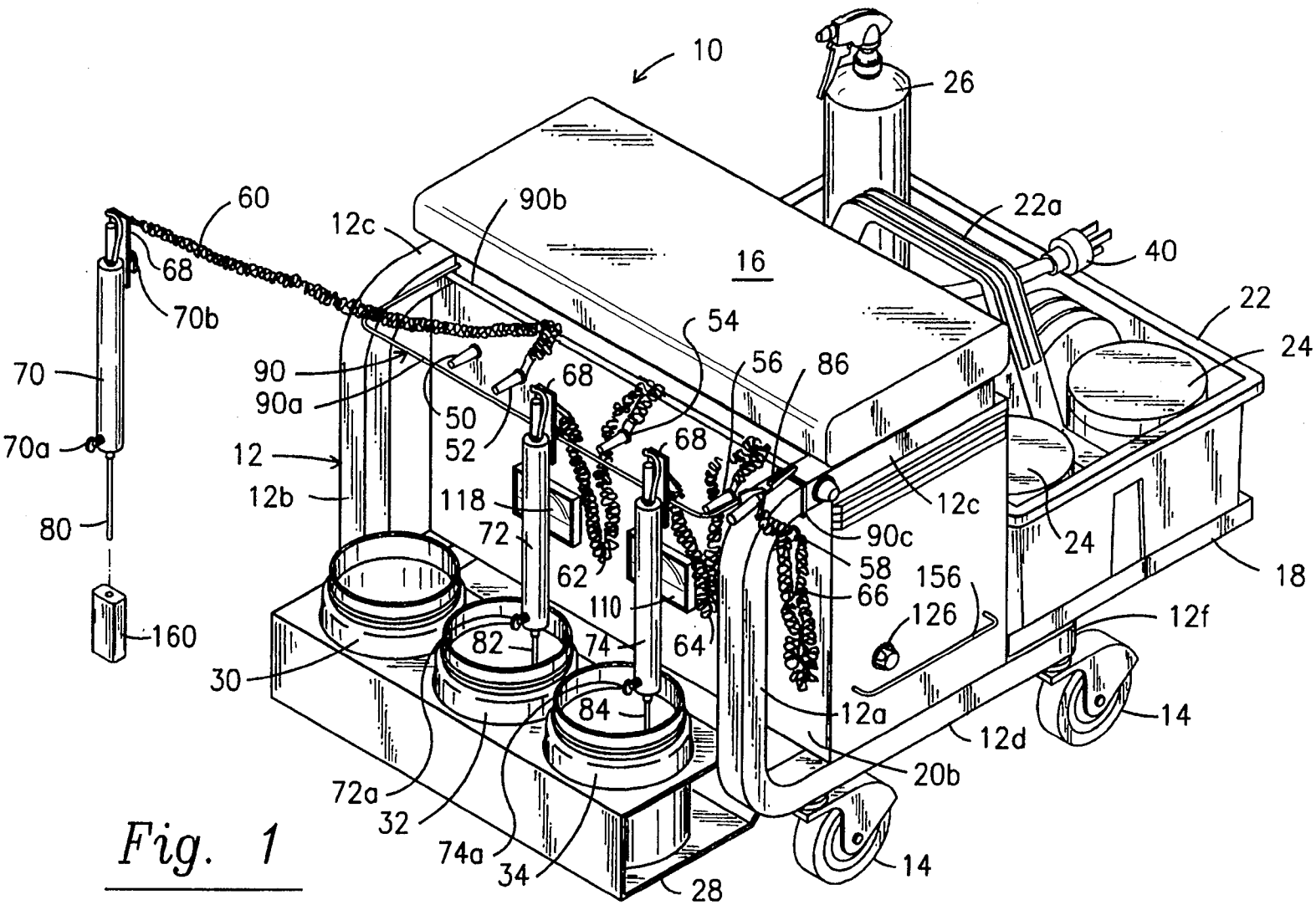
FIG. 1 is a view in perspective of an embodiment of the electroplating unit of the present invention.

Referring, now, to the drawings, the embodiment of the electroplating unit of this invention illustrated, and designated generally by reference numeral 10, comprises a support member or frame 12 formed by a pair of spaced, generally C-shaped side portions 12*a* and 12*b* each having an upper, horizontal arm 12*c* and a lower horizontal arm 12*d*. The ends of the arms 12*c* and 12*d* are interconnected by an upper crossbar 12*e* and a lower crossbar 12*f*, respectively. The frame 12 desirably is fabricated of a lightweight metal.

The frame 12 has two pairs of casters or wheels 14—14 secured to the lower arms 12*d* thereof. The casters or wheels 14—14 advantageously are freely rotatable through a 360 degree angle to impart optimum maneuverability to the unit 10.

A bench-like seat 16 extends across the frame 12 and is secured to the upper arms 12*c* of the side portions 12*a* and 12*b* of the frame 12. The seat 16 is padded, and has an upper surface area wide enough and long enough to comfortably accommodate a user of the unit 10.

A storage bin 18 is provided for the unit 10, and is positioned at the rear of the frame 12 along the lower crossbar 12*f* of the frame 12. The bin 18 is held on the frame 12 by bolts (not shown) to enable it to be freed from the frame 12 when, for some reason, it is desired to remove the D.C. power source 20 from the unit 10. The bin 18 is adapted to receive a tote box 22. The tote box 22 is provided with a handle 22*a*, and has sufficient capacity to receive containers 24 for holding all of the required chemical plating solutions, and equipment, such as protective gloves (not shown) and goggles (also not shown). A spray bottle 26, for water, is also provided to rinse away residual chemical solution from the workpiece so that the next step in the plating operation can proceed.

The front of the frame 12 has a tray 28 secured thereon for holding chemical solution containers 30, 32 and 34. The containers 30, 32 and 34 are maintained in stable, spaced relation to one another by cut-outs formed in the top 28*a* of the tray 28. Lids (not shown) are provided for each of the containers when the unit 10 is not in use or is being transported.

In the preferred embodiment of the unit 10 illustrated, the D.C. power source 20 is carried on the lower arms 12*d* of the frame 12 between the bin 18 and the tray 28, and below the seat 16. Extending outwardly from the rear wall 20*a* of the D.C. power source 20 is a three lead electrical cord 40 for connection to a 120 volt AC source, for example. The front wall 20*b* of the D.C. power source 20 is provided with five voltage output receptacles 42, 44, 46, 48 and 50 (see FIG. 4) for receiving connectors 52, 54, 56 and 58 each of which is secured at one end to retractable coiled leads or cables 60, 62, 64 and 66. The receptacles 42, 44, 46 and 48, and the connectors 52, 54, 56 and 58, desirably are of the banana jack plug and banana plug, respectively, type to provide secure contact between the power source 20 and the cables 60, 62, 64 and 66.

The other end of each of the cables 60, 62 and 64 is attached to a cable strain relief member 68 which is mounted on the end of hand manipulated, applicators or wands 70, 72 and 74. As shown, the wands 70, 72 and 74 are in the shape of elongated metallic cylinders, and each desirably is provided with a thumb screw 70*a*, 72*a* and 74*a*. The thumb screws 70*a*, 72*a* and 74*a* serve to releasably retain metallic anodes 80, 82 and 84 in position on the wands 70, 72 and 74.

The cable 66 can be connected through its connector or banana plug 58 to either receptacle or jack 42 or 50 of the D.C. power source 20, depending upon whether the user is left handed or right handed, and is provided at its other end with a workpiece contact member which may take the form of an alligator clip 86. The clip 86 acts as a cathode or anode during an electroplating operation, and serves to complete an electric circuit between the workpiece and the D.C. power source 20.

Figure 2:
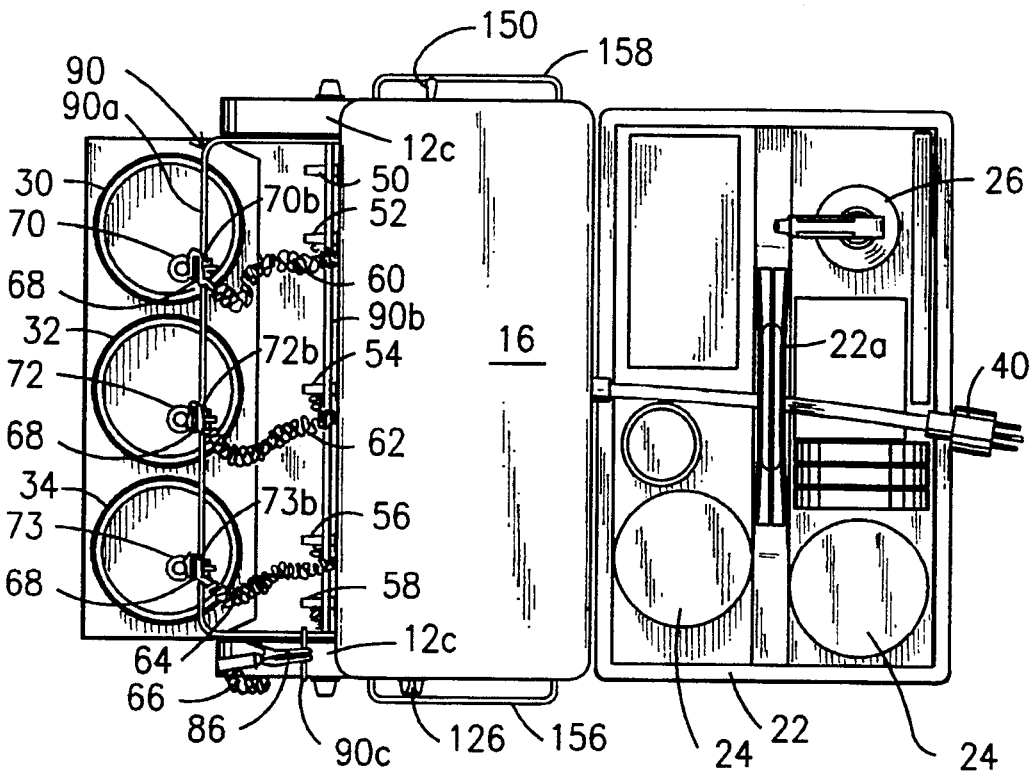
FIG. 2 is a top plan view of said embodiment.
Figure 3:
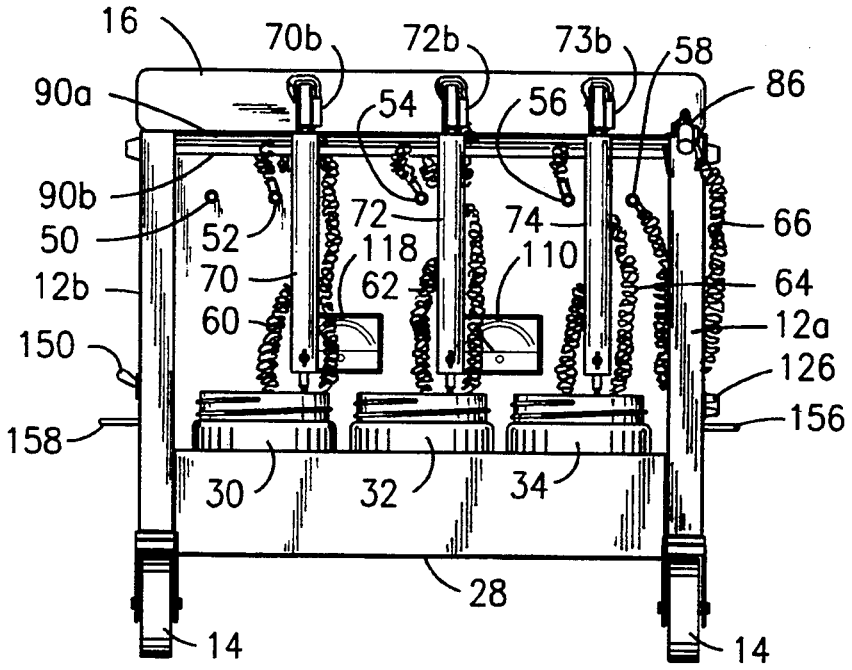
FIG. 3 is a front view in elevation of said embodiment.

As best shown in FIGS. 1 and 2 of the drawings, a wand and cable supporting rack 90 is positioned at the front of the unit 10 at a level below that of the top of the seat 16. The rack 90 includes an outer rod member 90*a* for supporting the wands 70, 72 and 74 above each of their associated chemical solution containers 30, 32 and 34. Each of the wands 70, 72 and 74 advantageously has a hook or clip 70*b*, 72*b* and 74*b* secured to the upper end thereof, adjacent to the strain relief member 68, which releasably snugly engages the rod member 90*a*, and maintains the wands in a fixed position thereon when awaiting use, or when not in use. The rack 90 also has an inner rod member 90*b* which enables a portion of each the cables 60, 62 and 64 to be looped thereover to provide a strain relief to prevent any possibility of the cables from being disconnected from the connectors or banana jacks 52, 54 and 56. An extension 90*c* is provided on the rack 90 for receiving the working end, or alligator clip 86, on the outer end of the cable 66.

Figure 4:
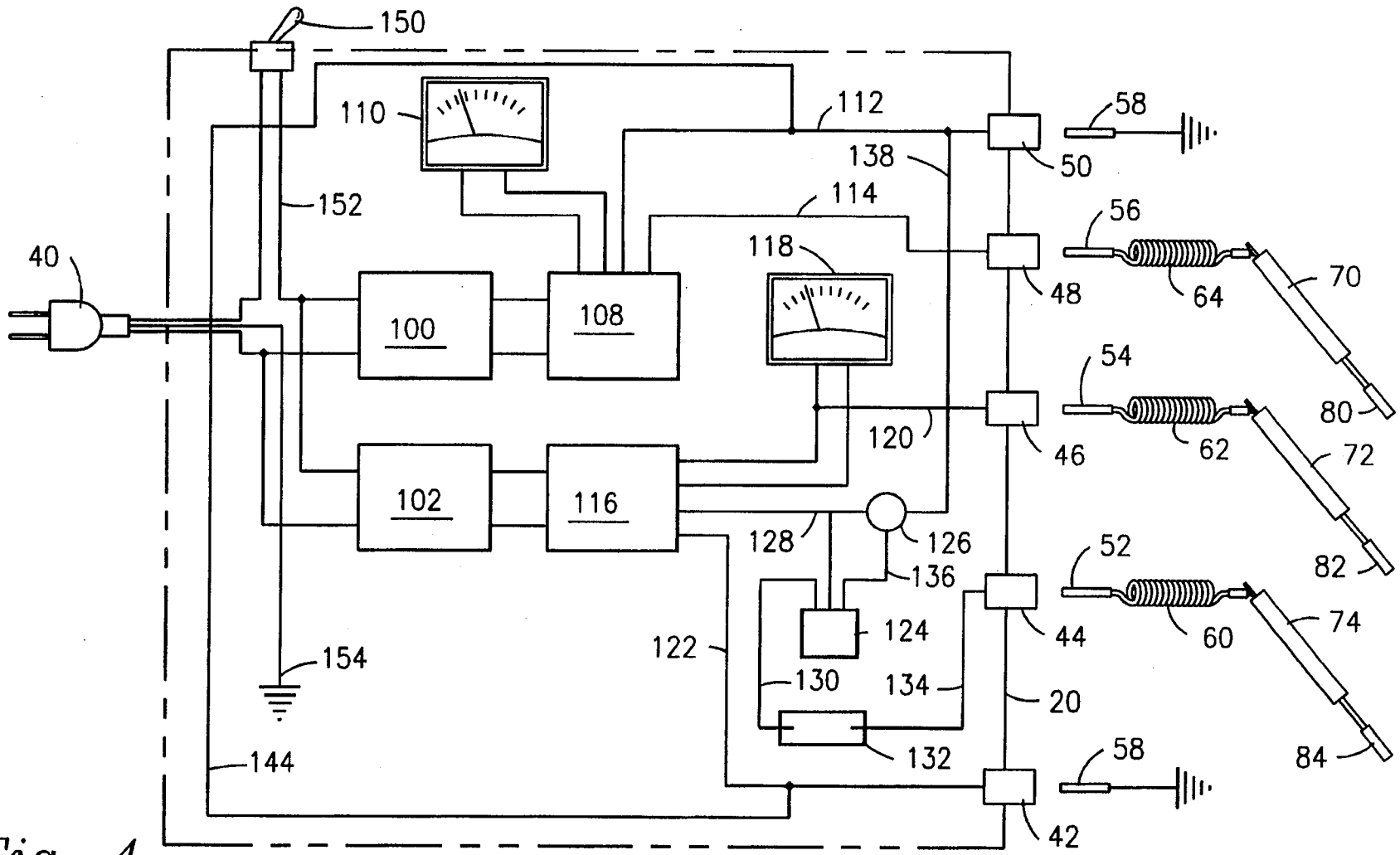
FIG. 4 is a schematic circuit diagram of a D.C. power source of the type incorporated in said embodiment of the invention.
Figure 5:
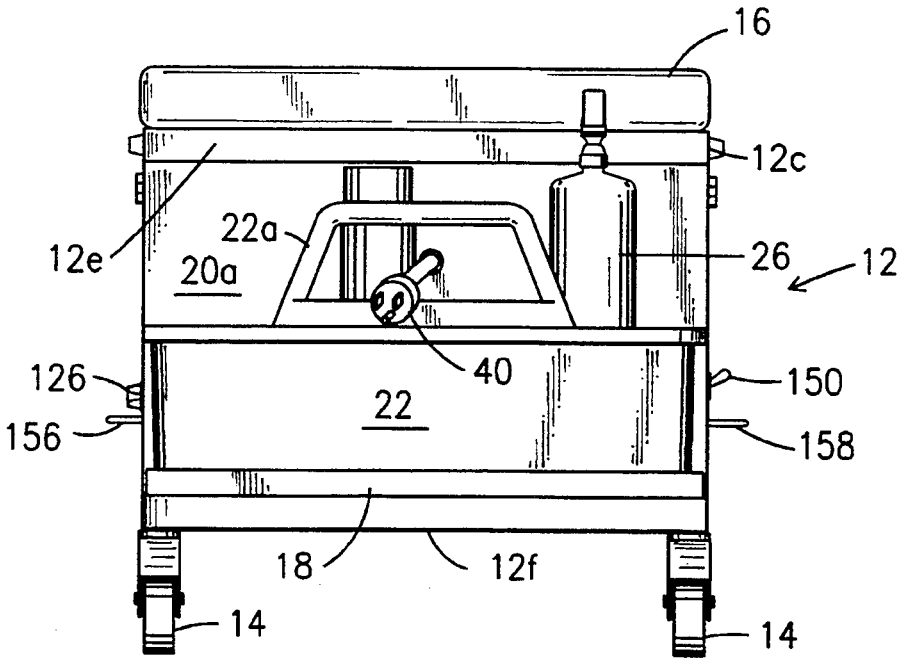
FIG. 5 is a rear view in elevation of said embodiment.
Figure 6:
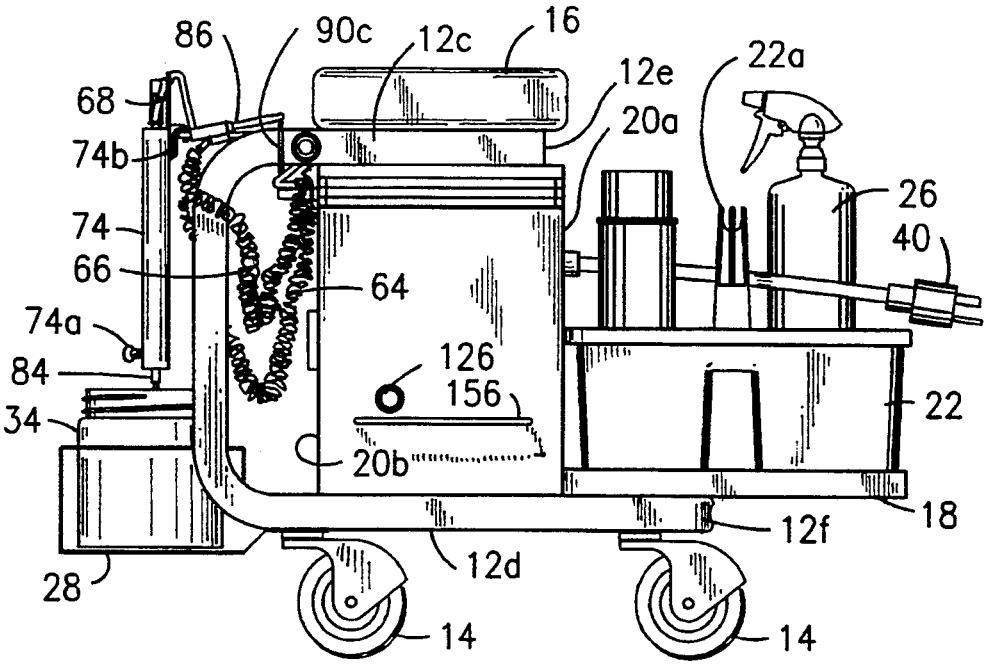
FIGS. 6 and 7 are side views in elevation of said embodiment.
Figure 7:
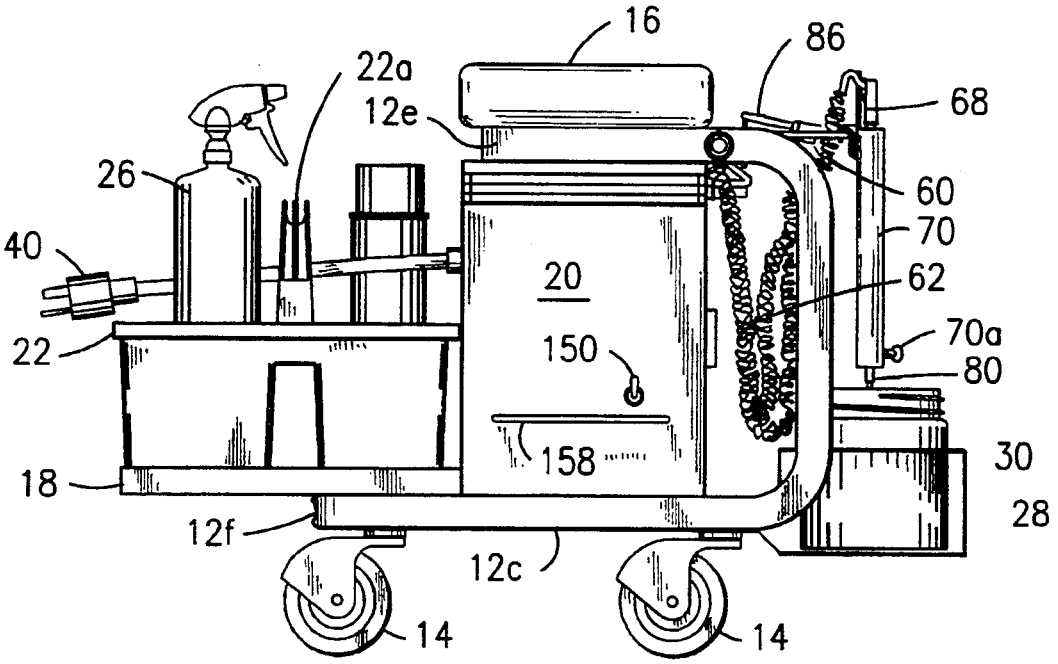
Figure 8:
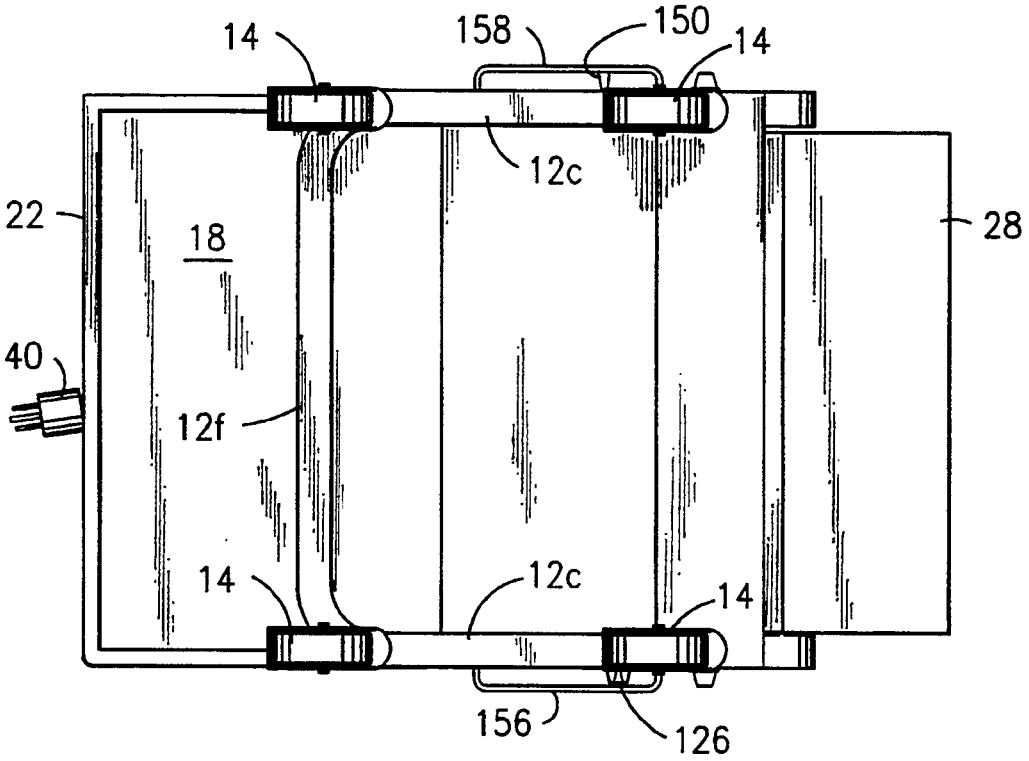
FIG. 8 is a bottom plan view thereof.

Referring, now, in particular to FIG. 4 of the drawings, a pair of transformers 100 and 102 are connected to the electric cord 40 through leads 104 and 106, respectively. The transformer 100 is connected to a full wave rectifier 108 which is connected to a D.C. voltmeter 110, and to banana jack 48 and banana jack 50 through leads 112 and 114, respectively. The rectifier 108 also includes a filter and current regulating circuit. The transformer 102 is connected to a full wave rectifier 116, which, in turn, is connected to a D.C. voltmeter 118. The rectifier 116 is also connected through lead 120 to banana jack 46, and to banana jack 42 through lead 122. The rectifier 116, like the rectifier 108, includes a filter and current regulating circuit. The rectifier 116 is further connected to a transistor 124 and an intensity adjustment control knob 126 by lead 128. The transistor 124 is connected by lead 130 to resistor 132. The resistor 132 is connected to banana jack 44 by lead 134. The transistor 124 is connected by lead 136 to the intensity adjustment control knob 126. The control knob 126, in turn, is connected by lead 138 to banana jack 50 across the lead 112. Ground line 140 is connected across leads 112 and 122 to banana jacks 42 and 50. An on-off switch 150 is connected to an A.C. power source, for example, through lead 152. The cord 40 is grounded to the D.C. power source housing as shown at 154.

The transformers, rectifiers, transistors and related electrical equipment are available commercially in preassembled form. Exemplary of such commercially available equipment are Models HB-1.7A+ and HD 12-6.8A+ sold by Condor Manufacturing Company located in Oxnard, Calif. The first mentioned model has a 1.7 ampere rating and is employed in the metal surface activator and gold plating operations performed by the unit 10. Model HD 12-6.8A+ has a 6.8 ampere rating and is employed in the metal stripping operation of the unit 10.

As stated above, the D.C. power source 20 has three voltage outlets, namely, receptacles or jacks 44, 46 and 48. Each of the wands 70, 72 and 74 is connected to its own voltage output source. The use of multiple voltage outputs, as opposed to a single output source, eliminates the need for the user to plug and unplug a single output lead for each wand before a step in the plating operation is performed. The voltage output for each wand is hard wired to the correct polarity and the voltage level needed to perform each step in the plating operation. Therefore, it is not necessary to provide a polarity switch or voltage adjustment for the unit 10 as in the case of the patented devices discussed initially.

When the power from the A.C. source is turned on by means of a switch 150, the readings on the D.C. volt meters 100 and 118 will be approximately 12 volts.

These values are preset at the correct level for each step of the plating operation. The D.C. power source automatically adjusts the output voltages if it senses too much current is being drawn through the wands, thus preventing any damage to the workpiece. Bumpers 156 and 158 desirably are provided on the side walls of the D.C. power source 20 to protect the knob 126 and the switch 150, respectively, from possible damage due to careless handling of the unit 10.

In utilizing the unit 10 to electroplate gold on chrome plated emblem of an automobile, for example, a user first pours a sufficient amount of the required chemical solutions into the containers 30, 32 and 34. For gold plating, approximately a 10% solution of sodium hydroxide is poured into the container 30 for stripping the chrome down to the nickel base of the emblem. An approximately 5% solution of sulfuric acid is poured into the container 32. The acid solution activates the nickel base for receiving the gold plating to be applied to the emblem. The container 34 is supplied with a metal ion activated solution of a gold salt such as potassium aurocyanide. The user then assumes a sitting position on the seat 16 with his or her legs straddling the chemical solution tray 28.

Each of the wands 70, 72 and 74, as stated, is provided with a metal anode 80, 82 and 84, desirably made of stainless steel. The anodes advantageously are rounded to prevent scratching the workpiece in the event the tips of the anodes, for some reason, become exposed through the sleeves. To facilitate successive application of the solutions on the workpiece, each of the anodes advantageously is provided with an absorbent sleeve 160 formed of cotton or other absorbent fabric, and stitched along one end to prevent the metal anode from coming into contact with the workpiece. The sleeve on the anode 80 of the wand 70 is first dipped into the base solution in the container 30, and the chemical solution saturated sleeve is brought into contact with the workpiece. During this step, as well as each of the succeeding steps, the alligator clip 86 is maintained in touch-contact with the workpiece. After the chrome layer has been removed with the base solution, the wand 70 is hung on the front rod 90*a* of the rack 90. The chrome free surface is rinsed with water to remove any residual base solution. A drip pan (not shown) desirably is used to intercept any fluid run-off from the workpiece. The user then takes the wand 72, and dips the absorbent sleeve carried on the anode 82 thereof into the acid solution in the container 32. The acid solution retained on the sleeve is then brought into contact with the surface of the workpiece and performs the activation step. As before, the wand 72 is hung on the rod 90 of the rack 90, and the acid treated solution is rinsed away. The third, and final step involves dipping the absorbent sleeve on the anode 84 of the wand 74 into the gold salt solution in the container 34. The sleeve with the gold solution absorbed therein is then brought into contact with the workpiece until a gold film of the desired thickness is attained. The rate of deposition of the gold on the workpiece can be controlled by the intensity adjustment knob 126. The knob only affects the gold plating wand 74, and is adjusted to control the rate at which the gold is deposited during the plating procedure.

It will be apparent to those skilled in the art that various changes in form and detail of the invention as shown and described may be made. It is intended that any such changes be included within the spirit and scope of the claims appended hereto.

I claim:

1. Apparatus for plating metal surfaces, comprising: a support member, wheels provided on the support member to enable said member to be moved to any desired position during a metal plating operation, a seat provided for the support member to enable an operator to assume a sitting position on the support member while using the apparatus to plate a metal surface, a D.C. power source carried on the support member, a plurality of chemical solution receptacles positioned on the support member in proximal relation to the seat, and means provided on the support member for sequentially applying chemical solutions in said receptacles to a metal surface to be plated, said means being connectable to the D.C. power source for completing an electrical circuit from the D.C. power source to the metal surface to be plated.

2. Apparatus according to claim 1, wherein said means includes a plurality of hand manipulated applicators, each of the applicators being adapted to apply a different chemical solution on a metal surface to be plated, and wherein each of the applicators is connected to an electrical conduit, each of the conduits in turn being connectable to the D.C. power source.

3. Apparatus according to claim 2, wherein the electrical conduit for each of the applicators is attached to means on the applicators for relieving strains on the conduit during plating of a metal surface.

4. Apparatus according to claim 2, wherein each of the applicators is adapted to releasably receive a metallic anode.

5. Apparatus according to claim 4, wherein each of the metallic anodes is provided with a chemical solution absorbent cover for applying a chemical solution on a metal surface to be plated, said cover serving also to inhibit contact between the anode and said metal surface.

6. Apparatus according to claim 5, wherein the absorbent cover is made of cotton, said cover being closed at one end to prevent contact of its associated anode with a metal surface to be plated.

7. Apparatus according to claim 2, wherein means is provided on the support member for maintaining the applicators in a suspended position above the chemical solution receptacles, said means further acting to maintain the electrical conduits in spaced apart relation to prevent entanglement and contact of the conduits with the chemical solutions in said receptacles.

8. Apparatus according to claim 7, wherein said means comprises a rack having an inner member on which a portion at least of each of the electrical conduits is supported, and an outer member for supporting the applicators.

9. Apparatus as claimed in claim 8, wherein the applicators are provided with clips for releasably suspending the applicators on the outer member of the rack.

10. Apparatus according to claim 9, wherein a metallic metal surface engaging clip is secured to an end of the electrical conduit.

11. Apparatus according to claim 9, wherein the clips are fabricated of a non-electrically conductive material.

12. Apparatus according to claim 7, wherein the electrical conduits comprise retractable cables.

13. Apparatus according to claim 2, wherein the D.C. power source is provided with a plurality of spaced, voltage output receptacles, each of said receptacles being adapted to receive a connector provided on each of the electrical conduits.

14. Apparatus according to claim 13, wherein each of the receptacles of the D.C. power source has its own voltage output, the voltage being automatically maintained at a predetermined level by the D.C. power source.

15. Apparatus according to claim 13, wherein the voltage output receptacles comprise banana jacks, and the connector on each of the electrical conduits is a banana plug for engagement in the banana jacks.

16. Apparatus according to claim 1, wherein the wheels for the support member are adapted to freely swivel in relation to the support member thereby enhancing the positioning and maneuverability of the apparatus.

17. Apparatus according to claim 1, wherein means is provided on the support member for storing chemical solutions and equipment employed in the plating operation.

18. Apparatus according to claim 17, wherein said means comprises a compartment for receiving a removable tray for storing said chemical solutions and equipment.

19. Apparatus according to claim 1, wherein the support member comprises a lightweight frame having an upper portion for supporting the seat, and a lower portion for supporting the chemical solution receptacles and the D.C. power source.

20. Apparatus according to claim 1, wherein said means includes a hand manipulated cathode member adapted to be maintained in contact with a metal surface to be plated during plating.

21. Apparatus according to claim 20, wherein the cathode member is provided with an electrical conduit which is connectable to the D.C. power source.

22. Apparatus according to claim 1, wherein the D.C. power source is provided with a lead connectable to an A.C. power source.

23. Apparatus for electroplating gold on selected metal surfaces of metal vehicles, comprising a frame; wheels provided on the frame to enable it to be easily moved along the exterior of a motor vehicle; a seat supported on the frame to enable a user of the apparatus to assume a sitting position on the frame during the plating operation; a D.C. power source carried on the frame; a tray provided on the frame for receiving chemical solution receptacles; a plurality of hand manipulated applicators supported on the frame, each of the applicators having an electrical conduit connectable to the D.C. power source and a anode for conveying chemical plating solutions to a metal surface to be gold plated, and a cathode provided with an electrical conduit for connection to the D.C. power source and including a metal surface contacting member for engaging a metal surface to be gold plated thereby to complete an electrical circuit from the D.C. power source to said metal surface.

24. Apparatus according to claim 23, wherein a storage compartment is provided for the frame for holding chemical solutions and other equipment used in the gold plating operation.

25. Apparatus according to claim 23, wherein the D.C. power source has a plurality of spaced, voltage output receptacles, each of said receptacles being capable of providing its own voltage, the voltage at each receptacle being automatically maintained at a predetermined level by the D.C. power source.

26. Apparatus according to claim 23, wherein the anode of each of the applicators is provided with an absorbent fabric sleeve for applying a chemical plating solution on a metal surface to be gold plated, each of the sleeves being closed at one end to prevent the anodes from making direct contact with said metal surface.

27. Apparatus according to claim 23, wherein an end of the electrical conduit for each of the applicators is attached to a strain relief member for relieving strains on said end of the conduit during plating of a metal surface.

* * * * *